US011686090B2

(12) United States Patent
Pylypczak et al.

(10) Patent No.: US 11,686,090 B2
(45) **Date of Patent: *Jun. 27, 2023**

(54) LEVELING ASSEMBLY

(71) Applicant: Teknion Limited, Toronto (CA)

(72) Inventors: Mark Pylypczak, Mississauga (CA); Hugues Gagnon, Québec (CA); Richard Dubé, Lévis (CA); Zoran Baic, Mississauga (CA); Youssef Adib, Lévis (CA); Paul Kruger, Toronto (CA)

(73) Assignee: Teknion Limited, Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/692,352

(22) Filed: Mar. 11, 2022

(65) Prior Publication Data

US 2022/0195726 A1 Jun. 23, 2022

Related U.S. Application Data

(63) Continuation of application No. 16/678,164, filed on Nov. 8, 2019, now Pat. No. 11,299,887.

(51) Int. Cl.
*E04B 2/82* (2006.01)
*E04B 2/74* (2006.01)

(52) U.S. Cl.
CPC ..... *E04B 2/82* (2013.01); *E04B 2/7401* (2013.01); *E04B 2002/7492* (2013.01)

(58) Field of Classification Search
CPC .. E04B 2/82; E04B 2/7401; E04B 2002/7492; E04B 2/825
See application file for complete search history.

(56) References Cited

U.S. PATENT DOCUMENTS 2,963,131 A 12/1960 Brockway
3,335,532 A 8/1967 Greenbie
(Continued)

FOREIGN PATENT DOCUMENTS

EP 2199481 B1 10/2011

OTHER PUBLICATIONS

Vetroin, Truelight Assembly Instructions Rev.03 (Nov. 19, 2012).
Haworth, Haworth Esedra3 Product Handbook, version 06.10 (Jun. 2010).

*Primary Examiner* — Adriana Figueroa
(74) *Attorney, Agent, or Firm* — Bereskin & Parr LL/S.E.N.C.R.L., s.r.l.

(57) ABSTRACT

A leveling assembly for leveling a bottom edge of an interior wall panel includes an elongate floor channel secured to the floor, a floor rail at least partially disposed with the floor channel for supporting the bottom edge of the wall panel, and at least one leveler at least partially located within the floor rail. Each leveler includes a head couplable to the floor channel, an adjustment rod projecting from the head, and a rail support having a collar and a support shoulder extending outwardly from the collar. The head is substantially prevented from transverse movement when coupled to the floor channel. The collar passes through an aperture defined in a horizontal portion of the floor rail and is threadedly engaged with the adjustment rod. The support shoulder supports the floor rail. The adjustment rod is rotated to vary a vertical distance between the floor rail and the floor channel.

19 Claims, 5 Drawing Sheets

(56) References Cited

U.S. PATENT DOCUMENTS

| | | | | |
|---|---|---|---|---|
| 3,638,376 | A | 2/1972 | Howes et al. | |
| 3,834,092 | A | 9/1974 | Whisson | |
| 3,885,361 | A | 5/1975 | De Schutter | |
| 4,084,289 | A | 4/1978 | Naimo | |
| 4,277,920 | A * | 7/1981 | Dixon | E05D 15/0613 52/64 |
| 4,391,073 | A | 7/1983 | Mollenkopf et al. | |
| 4,449,337 | A * | 5/1984 | Gzym | E04B 2/825 52/242 |
| 5,155,955 | A * | 10/1992 | Ball | E04B 2/82 52/239 |
| 5,417,021 | A | 5/1995 | Favshanjian | |
| 5,644,877 | A * | 7/1997 | Wood | E04B 2/7407 52/241 |
| 6,003,273 | A | 12/1999 | Elsholz et al. | |
| 6,883,277 | B2 * | 4/2005 | Wiechecki | E04B 2/824 52/36.5 |
| 7,814,711 | B2 * | 10/2010 | Milligan | E04B 2/7401 52/220.1 |
| 7,861,474 | B2 | 1/2011 | Houle et al. | |
| 8,635,815 | B2 | 1/2014 | Bordin | |
| 9,057,201 | B2 * | 6/2015 | Milligan | E06B 3/54 |
| 9,732,521 | B2 | 8/2017 | Babikian | |
| 9,982,431 | B2 * | 5/2018 | Del missier | E04B 2/7448 |
| 10,053,858 | B2 * | 8/2018 | Kopish | E04B 2/74 |
| 10,508,441 | B2 * | 12/2019 | Kopish | E04F 21/1877 |
| 11,299,887 | B2 | 4/2022 | Pylypczak et al. | |
| 2010/0242378 | A1 | 9/2010 | Cifelli | |
| 2013/0192141 | A1 | 8/2013 | Kopish et al. | |
| 2013/0192148 | A1 | 8/2013 | Milligan et al. | |
| 2021/0087813 | A1 * | 3/2021 | Eyme | E04B 2/745 |

* cited by examiner

LEVELING ASSEMBLY

CROSS-REFERENCE TO RELATE APPLICATION

This application is a continuation of U.S. application Ser. No. 16/678,164, filed Nov. 8, 2019, which is incorporated by reference herein in its entirety.

FIELD

This application relates generally to interior wall systems for buildings, and more specifically to a leveling assembly for leveling an interior wall panel.

INTRODUCTION

Interior wall systems are well known. Such systems are commonly used, for example, to finish the open areas in office buildings. One type of interior wall system is a modular partition wall system which is composed of a number of wall panels in a side-by-side arrangement. An example of such a system is described in Applicant's U.S. Pat. No. 7,814,711, which is incorporated by reference herein in its entirety.

The above interior wall systems are typically constructed using glass wall panels (whether transparent, translucent, or opaque) and have become increasingly popular due to their aesthetic, environmental and workplace planning qualities. Such wall systems are commonly referred to as "seamless glass walls" or "butt glazed walls".

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of the teachings described herein, a leveling assembly for leveling a bottom edge of an interior wall panel is provided. The interior wall panel is configured for installation on a floor. The leveling assembly comprises:

an elongate floor channel configured to be operatively secured to the floor, the floor channel having a bottom surface;

a floor rail configured to be at least partially disposed within the floor channel, the rail having a generally horizontal portion and a pair of spaced apart rail walls extending upwardly and downwardly from the horizontal portion, wherein a plurality of apertures are defined along the horizontal portion;

a pair of elongate floor trim members, wherein each floor trim member is releasably securable to an upper portion of a corresponding one of the pair of rail walls, wherein a top edge of each floor trim member is configured to operatively engage the interior wall panel;

at least one panel support configured to be positioned within the floor rail, wherein the at least one panel support is configured to support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is spaced apart from the bottom surface of the floor channel and is substantially prevented from vertical movement; and a rail support having a collar and a support shoulder extending outwardly from the collar, the collar having an interior threaded surface configured to engage the threaded portion of the adjustment rod, wherein the collar is configured to pass through one of the plurality of apertures in the horizontal portion, wherein the support shoulder is configured to abut against a lower surface of the horizontal portion to support the floor rail;

wherein rotation of the adjustment rod is configured to vary a vertical distance between the horizontal portion of the floor rail and the bottom surface of the floor channel.

In some embodiments, the rail support is adapted for substantially vertical movement along the adjustment rod.

In some embodiments, the at least one panel support comprises:

a support body having an upper surface, a lower surface, and a substantially vertical bore extending therethrough, wherein the lower surface is configured to rest on the horizontal portion of the floor rail;

an internally threaded sleeve configured to be rotatably secured in the bore of the support body, the sleeve having a flange at an upper end thereof, wherein, when the sleeve is secured in the bore, the flange is located above the upper surface; and a bolt having a hat and a threaded rod projecting from the hat, wherein the threaded rod is adapted to be threadedly received within the sleeve, wherein the hat defines a groove adapted to receive the bottom edge of the interior wall panel;

wherein rotation of the flange causes vertical movement of the bolt, thereby varying a vertical distance between the hat and the horizontal portion of the floor rail.

In some embodiments, each floor trim member comprises a longitudinally extending ridge along an inner surface thereof, the ridge and the inner surface defining an insertion slot therebetween, wherein the insertion slot is configured to receive the upper portion of a corresponding one of the pair of rail walls.

In some embodiments, the leveling assembly further comprises at least one spring clip configured to be positioned within the floor rail, wherein the at least one spring clip is configured to snap fit the upper portion of each rail wall to the insertion slot of a corresponding one of the pair of floor trim members.

In some embodiments, each floor trim member comprises a longitudinally extending gasket along the inner surface thereof, wherein, when each floor trim member is secured to the upper portion of a corresponding one of the pair of rail walls, the gasket of each trim member abuts opposing surfaces of the interior wall panel.

In some embodiments, the floor channel comprises a longitudinal passage, wherein, when the head is coupled in the floor channel: (i) the head is located in the passage, (ii) the head is free to rotate, and (iii) the head is substantially prevented from transverse horizontal and vertical movement.

In some embodiments, a pair of spaced apart, elongate, substantially parallel protrusions extend upwardly from the bottom surface of the floor channel, wherein each protrusion comprises a longer portion and a shorter portion, wherein the passage extends between the longer portion and the shorter portion of each protrusion, wherein outer portions of the head are received between the shorter portion and the longer portion of each protrusion.

In some embodiments, each rail wall comprises a longitudinally extending track defined along an inner surface thereof below the horizontal portion, wherein opposing resilient distal portions of the support shoulder are configured to snap into the tracks.

In some embodiments, the floor channel comprises a pair of spaced apart channel walls extending upwardly and perpendicularly from opposing edges of the bottom surface.

In some embodiments, the floor channel comprises a pair of elongate footings configured to rest on the floor, wherein each footing projects outwardly from a corresponding one of the pair of channel walls.

In some embodiments, the floor channel includes an elongate strip of resilient material underneath the bottom surface.

In some embodiments, the floor channel is secured to the floor by a plurality of fasteners, wherein each fastener passes through the bottom surface of the floor channel and engages the floor.

According to another broad aspect of the teachings described herein, a leveling assembly for leveling a bottom edge of an interior wall panel is provided. The interior wall panel is configured for installation on a floor. The assembly comprises:

an elongate floor channel configured to be operatively secured to the floor, the floor channel having a bottom surface;

a floor rail configured to be at least partially disposed within the floor channel, the rail having a generally horizontal portion and a pair of spaced apart rail walls extending upwardly from the horizontal portion, wherein a plurality of apertures are defined along the horizontal portion, the floor rail configured to operatively support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is spaced apart from the bottom surface of the floor channel and is substantially prevented from vertical movement; and a rail support having a collar and a support shoulder extending outwardly from the collar, the collar having an interior threaded surface configured to engage the threaded portion of the adjustment rod, wherein the collar is configured to pass through one of the plurality of apertures in the horizontal portion, wherein the support shoulder is configured to abut against a lower surface of the horizontal portion to support the floor rail;

wherein rotation of the adjustment rod is configured to vary a vertical distance between the horizontal portion of the floor rail and bottom surface of the floor channel.

In some embodiments, the leveling assembly further comprises at least one panel support configured to be positioned within the floor rail, wherein the at least one panel support is configured to support the bottom edge of the interior wall panel.

In some embodiments, a pair of spaced apart, elongate, substantially parallel protrusions extend upwardly from the bottom surface of the floor channel, wherein each protrusion comprises a longer portion and a shorter portion, wherein a passage extends between the longer portion and the shorter portion of each protrusion, wherein outer portions of the head are received between the shorter portion and the longer portion of each protrusion, and wherein, when the head is coupled in the floor channel: (i) the head is located in the passage, (ii) the head is free to rotate, and (iii) the head is substantially prevented from transverse horizontal and vertical movement.

In some embodiments, the leveling assembly further comprises a pair of elongate floor trim members, wherein each floor trim member is releasably securable to an upper portion of a corresponding one of the pair of rail walls, wherein each floor trim member comprises a longitudinally extending gasket along the inner surface thereof, wherein, when each floor trim member is secured to the upper portion of the corresponding one of the pair of rail walls, the gasket of each trim member abuts opposing surfaces of the interior wall panel.

According to another broad aspect of the teachings described herein, a leveling assembly for leveling a bottom edge of an interior wall panel is provided. The interior wall panel is configured for installation on a floor. The leveling assembly comprises:

an elongate floor channel configured to be operatively secured to the floor, the floor channel having a bottom surface;

a floor rail configured to be at least partially disposed within the floor channel, the rail having a generally horizontal portion and a pair of spaced apart rail walls extending upwardly from the horizontal portion; wherein a plurality of apertures are defined along the horizontal portion, the floor rail configured to operatively support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is substantially prevented from transverse movement; and a rail support having a collar and a support shoulder extending outwardly from the collar, the collar having an interior threaded surface configured to engage the threaded section of the adjustment rod, wherein the collar is configured to pass through one of the plurality of apertures in the horizontal portion, wherein the support shoulder is configured to abut against a lower surface of the horizontal portion to support the floor rail;

wherein rotation of the adjustment rod is configured to vary a vertical distance between the horizontal portion of the floor rail and the bottom surface of the floor channel.

In some embodiments, the floor channel comprises a longitudinal passage, wherein, when the head is coupled in the floor channel: (i) the head is located in the passage, (ii) the head is free to rotate, and (iii) the head is substantially prevented from transverse horizontal and vertical movement.

In some embodiments, a pair of spaced apart, elongate, substantially parallel protrusions extend upwardly from the bottom surface of the floor channel, wherein each protrusion comprises a longer portion and a shorter portion, wherein the passage extends between the longer portion and the shorter portion of each protrusion, wherein outer portions of the head are received between the shorter portion and the longer portion of each protrusion.

It will be appreciated by a person skilled in the art that a method or apparatus disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
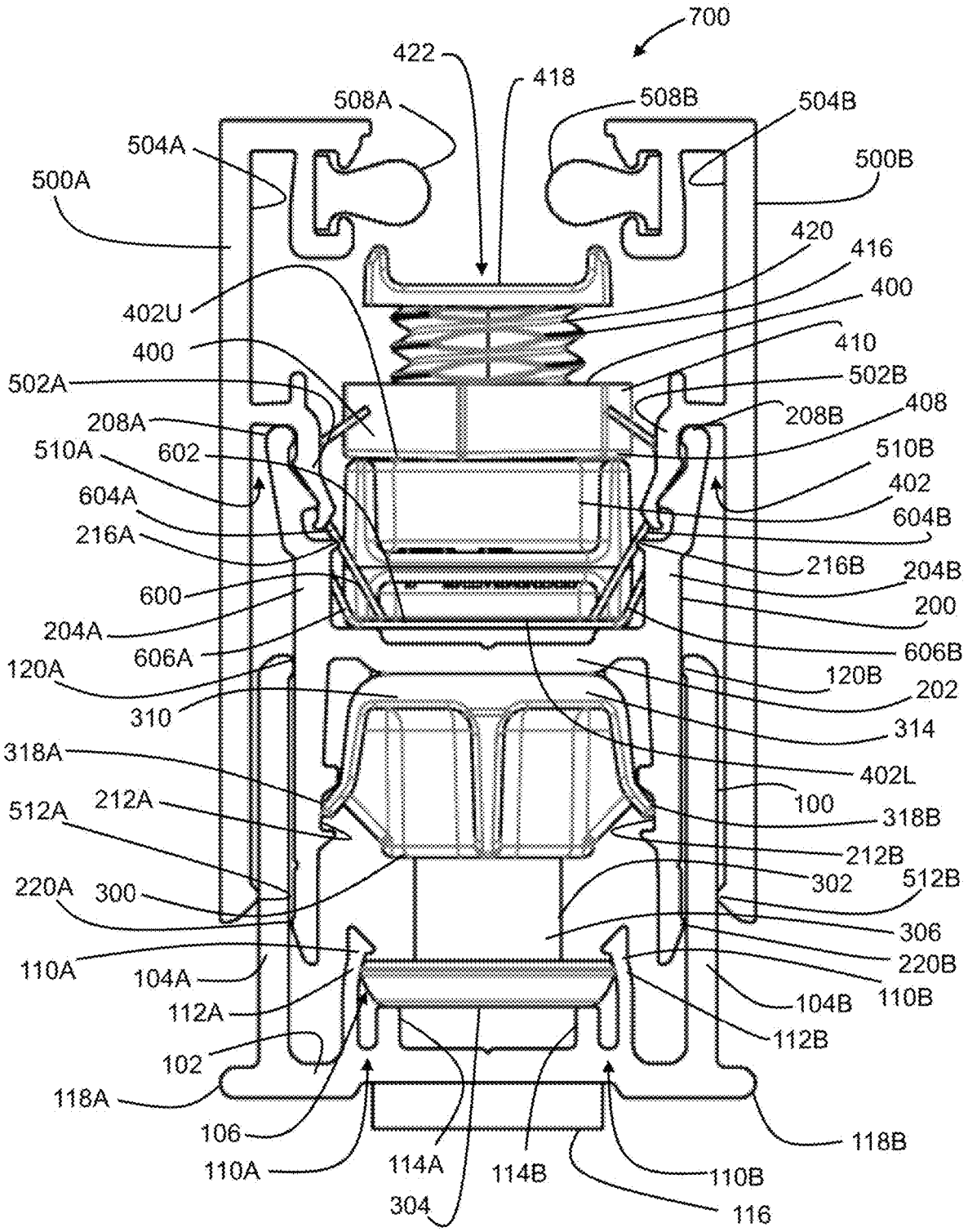
FIG. 1 is a side elevation view of a leveling assembly in accordance with an exemplary embodiment.

The drawings included herewith are for illustrating various examples of articles, methods, and apparatuses of the teaching of the present specification and are not intended to limit the scope of what is taught in any way.

DETAILED DESCRIPTION

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment", "the embodiments", "one or more embodiments", "some embodiments", and "one embodiment" mean "one or more (but not all) embodiments of the present invention(s)", unless expressly specified otherwise.

The terms "including", "comprising", and variations thereof mean "including but not limited to", unless expressly specified otherwise. A listing of items does not imply that any or all of the items are mutually exclusive, unless expressly specified otherwise. The terms "a", "an", and "the" mean "one or more", unless expressly specified otherwise.

The use of the words "vertical" or "horizontal" are used herein to indicate orientation of elements once installed and/or assembled, and are not intended to be used in a limiting way.

Figure 2:
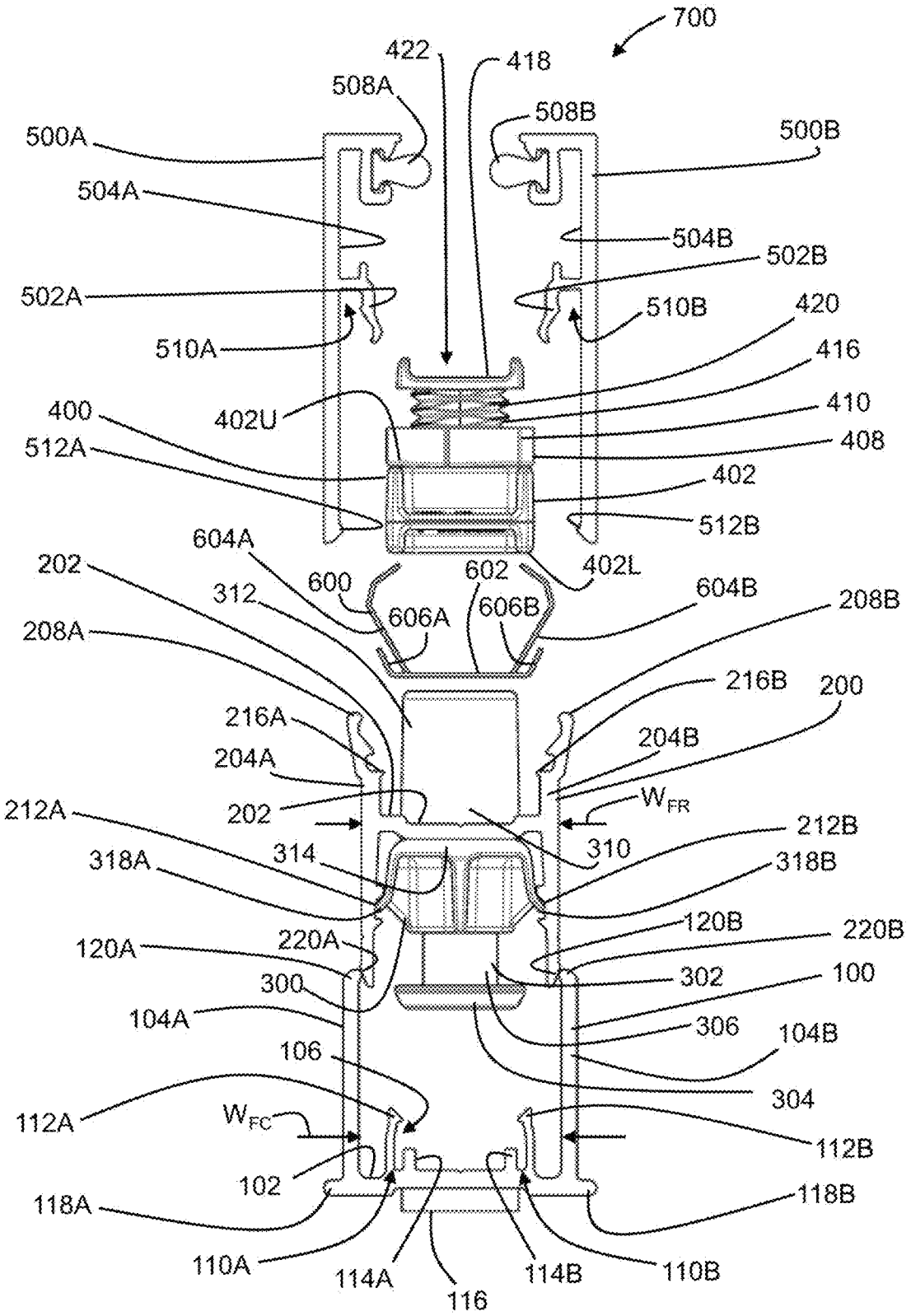
FIG. 2 is an exploded side elevation view of the leveling assembly of FIG. 1.
Figure 3:
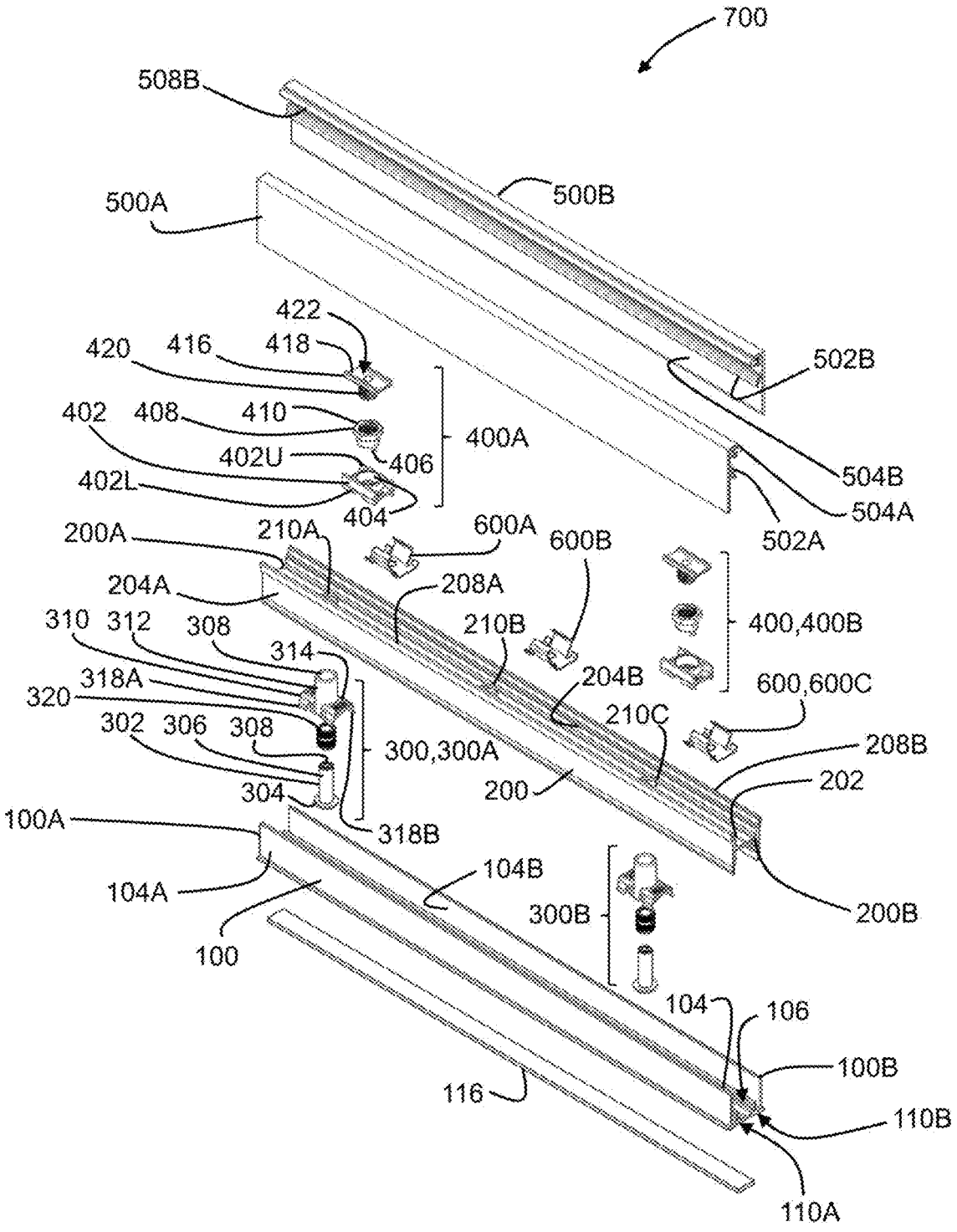
FIG. 3 is an exploded perspective view of the leveling assembly of FIG. 1.

FIGS. 1-3 illustrate an exemplary leveling assembly, referred to generally as 700. The leveling assembly 700 supports a bottom edge 900B of an interior wall panel 900 (shown in FIGS. 5A-C).

In some cases, the location where an interior wall system is installed does not have consistent floor to ceiling dimensions. Variations in the floor to ceiling dimension along the length of the interior wall system can lead to installation difficulties and create an unpleasant aesthetic appearance. For example, these variations may require custom alterations to be made to the interior wall system components during installation. These alterations are often difficult to perform and cause delays, leading to an inefficient and costly installation process or a less desirable appearance. The leveling assembly 700 allows adjustment of the orientation of the interior wall panel 900 in relation to the floor, including, without limitation, leveling the bottom edge of the interior wall panel with the horizontal. This adjustment capability allows it to accommodate for variations in floor to ceiling dimensions and provide an improved appearance. For clarity, the description below will describe using the leveling assembly 700 to level the bottom edge of the interior wall panel with the horizontal. However, those skilled in the art will appreciate that the leveling assembly may be used to adjust the interior wall panel to other desirable orientations.

Continuing to refer to FIGS. 1-3, the leveling assembly 700 includes an elongate floor channel 100. The floor channel 100 extends longitudinally from a first channel end 100A to a second channel end 100B. The floor channel 100 has a bottom surface that rests on a floor 1002 (shown in FIGS. 5A-5C). In the illustrated example, the floor channel 100 includes a pair of spaced apart channel walls 104A and 104B extending upwardly and perpendicularly from opposing edges of the bottom surface 102, thereby giving the floor channel 100 a generally U-shaped cross-section. The floor channel 100 is preferably an aluminum extrusion or another suitable metal or alloy extrusion. However, the floor channel may be composed of any other suitable material, such as plastic, and can be manufactured in any other suitable way.

The floor channel 100 can be secured to the floor in a number of suitable ways, e.g. by mechanical fasteners, adhesive, etc. For example, the floor channel 100 may be secured to the floor by a plurality of fasteners (not shown). In such cases, the fasteners may pass through the bottom surface 102 of the floor channel 100 to engage the floor 1002.

In the illustrated example, the floor channel 100 includes an elongate strip of resilient material 116 underneath the bottom surface 102. With reference to FIG. 3, the resilient material 116 extends longitudinally between the first and second channel ends 100A and 100B. For example, the resilient material 116 may be a compressible foam, rubber or another suitable material. When the floor channel 100 is secured to the floor (e.g. as described above), the resilient material 116 is compressed between the bottom surface 102 and the floor 1002 to produce a seal (e.g. see FIGS. 5A-5C). In this arrangement, the resilient material 116 may provide improved sound attenuation and insulation.

In the illustrated example, the floor channel 100 includes a pair of elongate footings 118A and 118B that rest on the floor. As best shown in FIG. 2, the footings 118A and 118B project outwardly from the channel walls 104A and 104B, respectively. The footings 118A and 118B can improve stability of the floor channel 100 when resting on the floor 1002 (e.g. see FIGS. 5A-5C). The footings 118A and 118B preferably extend longitudinally between the first and second channel ends 100A and 100B, e.g. as shown in FIG. 3.

The leveling assembly 700 also includes a floor rail 200. The floor rail 200 supports the bottom edge 900B of the interior wall panel 900. The floor rail 200 extends longitudinally from a first rail end 200A to a second rail end 200B. The floor rail 200 is preferably an aluminum extrusion or another suitable metal or alloy extrusion. However, the floor rail 200 may be composed of any other suitable material, such as plastic, and can be manufactured in any other suitable way.

The floor rail 200 includes a generally horizontal portion 202 and a pair of spaced apart rail walls 204A and 204B extending upwardly from the horizontal portion 202. In the illustrated example, the rail walls 204A and 204B extend upwardly and downwardly from the horizontal portion 202, thereby giving the floor rail 200 a generally H-shaped cross-section.

Referring to FIG. 2, an outer width $W_{FR}$ of the floor rail 200 is measured between external surfaces of the rail walls 204A and 204B. An inner width $W_{FC}$ of the floor channel 100 is measured between internal surfaces of the channel walls 104A and 104B. The outer width $W_{FR}$ of the floor rail 200 is slightly smaller than the inner width $W_{FC}$ of the floor channel 100. In this way, when longitudinally aligned, the floor rail 200 can fit snugly within the floor channel 100. This snug fit can reduce transverse horizontal movement of the floor rail 200 within the floor channel 100 and, as a result, improve stability of the leveling assembly 700.

In the illustrated example, each channel wall 104A, 104B includes a longitudinally extending channel lip 120A, 120B along a top edge thereof. The channel lips 120A and 120B protrude slightly inwardly of the floor channel 100. The channel lips 120A and 120B preferably extend between the first and second channel ends 100A and 100B. In the illustrated example, each rail wall 204A, 204B includes a longitudinally extending rail lip 220A, 220B along a bottom edge surface thereof. The rail lips 220A and 220B protrude slightly outwardly of the floor rail 200. The rail lips 220A and 220B preferably extend between the first and second rail ends 200A and 200B. Referring to FIG. 1, when the floor rail 200 is at least partially inserted with the floor channel 100: i) the channel lips 120A and 120B abut the rail walls 204A and 204B, respectively, and ii) the rail lips 220A and 220A abut the channel walls 104A and 104B, respectively. This arrangement creates contact points that reduce surface-to-surface contact between the rail wall 204A and the channel wall 104A and between the rail wall 204B and the channel wall 104B that can simplify positioning the floor rail 200 within the floor channel 100 and/or reduce wear caused by shear. Alternatively, or in addition, contact between the channel lips 120A and 120B and the rail walls 204A and 204B, respectively, may provide stability to the floor rail 200, e.g. by limiting movement and/or twisting of the floor rail 200.

Referring to FIG. 3, a plurality of apertures 210 are defined along the horizontal portion 202 of the floor rail 200. In the illustrated example, three circular apertures 210A, 210B and 210C are defined in the horizontal portion 202 at regular intervals.

Referring to FIGS. 1-3, the leveling assembly 700 also includes at least one leveler 300 for adjustably supporting the floor rail 200 from the bottom surface 102 of the floor channel 100. For example, FIG. 3 shows two levelers 300A, 300B. To avoid cluttering FIG. 3, the parts of the levelers discussed below are only labeled on leveler 300A. The leveler 300 includes a head 304, an adjustment rod 302 projecting from the head 304, and a rail support 310. The adjustment rod 302 has a threaded portion 306. The threading of the threaded portion 306 is omitted from FIGS. 1-3 for clarity. As will be described in more detail below, the head 304 of the leveler 300 is removably coupled to the floor channel 100. When the head 304 is coupled to the floor channel 100, the head 304 is prevented from at least vertical movement.

Referring to FIG. 3, the adjustment rod 302 has an axial opening 308 defined in a distal end thereof (i.e. the end opposite the head 304). The axial opening 308 is preferably a hex-shaped axial opening to engage an Allen key or the like. In such cases, the Allen key (not shown) may be used to rotate the adjustment rod 302 via the axial opening 308.

The rail support 310 has a collar 312 and a support shoulder 314 extending outwardly from the collar 312. In the illustrated example, the collar 312 is cylindrical, although other configurations are possible, e.g. rectangular, hexagonal, etc. The collar 312 has an interior threaded surface that engages the threaded portion 306 of the adjustment rod 302. Due to this threaded engagement, rotation of the adjustment rod 302 can move the rail support 310 along the adjustment rod 302.

In the illustrated example, the rail support 310 includes a threaded insert 320 to provide the interior threaded surface of the collar 312. The threaded insert 320 can be secured within the collar 312 in any suitable manner. It will be appreciated that the threaded insert 320 is not needed in embodiments where the interior threaded surface is integrally formed with the collar 312.

With reference to FIGS. 1 and 2, the collar 312 may pass through the horizontal portion 202 of the floor rail 200 via one of the plurality of apertures 210. In the illustrated example, an outer diameter of the cylindrical collar 312 is slightly smaller than a diameter of the circular apertures 210A, 210B and 210C defined in bottom surface 202 of the floor rail 200. Accordingly, the cylindrical collar 312 is able to pass through one of the circular apertures 210A, 210B, and 210C.

Unlike the collar 312, the support shoulder 314 is sized so that it cannot pass through one of the plurality apertures 210. Thus, when the collar 312 of the rail support 310 is inserted through one of the plurality of apertures 210, from below the horizontal portion 202, the support shoulder 314 abuts against a lower surface of the horizontal portion 202 to support the floor rail 200. As shown in FIGS. 1 and 2, the support shoulder 314 supports the floor rail 200 from below the horizontal portion 202.

Referring to FIG. 1, the adjustment rod 302 is rotatable (e.g. clockwise or counterclockwise) to vary a vertical distance between the horizontal portion 202 of the floor rail 200 and the bottom surface 102 of the floor channel 100. The adjustment rod 302 may be rotated until the horizontal portion 202 of the floor rail 200 is substantially leveled with the horizontal. In the illustrated example, the floor rail 200 is supported above the bottom surface 102 of the floor channel 100 by two levelers 300A and 300B. In this example, the adjustment rods 302 of one or both the levelers 300A and 300B may be independently rotated to substantially level the floor rail 200 with the horizontal. Thus, the vertical distance between the horizontal portion 202 of the floor rail 200 and the bottom surface 102 of the floor channel 100 may vary along the length of the floor channel 100.

The levelers 300 may be spaced at any suitable interval. For example, the levelers 300 may be spaced at an interval between about 5 and 20 inches (12.7 and 50.8 cm). Preferably, the levelers 300 may be spaced at an interval between about 10 and 14 inches (25.4 and 35.6 cm). More preferably, the levelers 300 are spaced at an interval of about 12 inches (30.5 cm). The number of levelers 300 used in the leveling assembly 700, and/or the spacing between levelers 300, may be varied according to the size and/or weight of the interior wall panel to be supported by the floor rail 200.

Figures 5A, 5B, 5C:
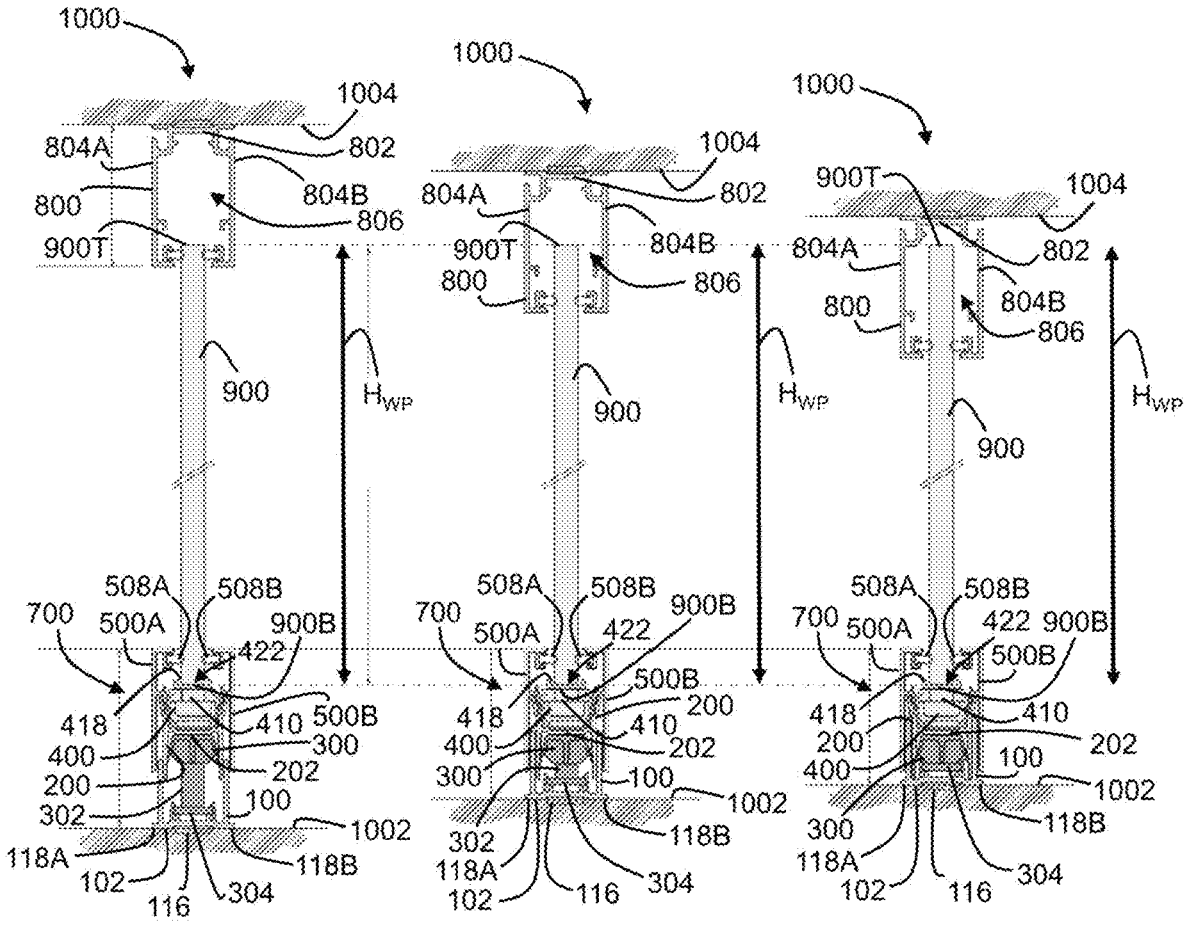
FIGS. 5A-5C are side elevation views of an interior wall system showing the example leveling assembly of FIG. 1 in three different configurations.

The floor rail 200 supports the bottom edge 900B of the interior wall panel 900 (best shown in FIGS. 5A-5C). Accordingly, by substantially leveling the floor rail 200 with the horizontal, the bottom edge of the interior wall panel may also be substantially leveled with the horizontal.

As best shown in FIG. 2, the floor channel 100 includes a longitudinal passage 106. When the head 304 is coupled to the floor channel 100: i) the head 304 is located in the passage 106, ii) the head 304 is free to rotate, and iii) the head 304 is substantially prevented from transverse horizontal and vertical movement.

In the illustrated example, the floor channel 100 includes a pair of spaced apart, elongate, substantially parallel protrusions 110A and 110B extending upwardly from the bottom surface 102. The protrusion 110A has a longer portion 112A and a shorter portion 114A spaced from the larger portion 114A. Similarly, the protrusion 110B has a longer portion 112B and a shorter portion 114B spaced from the larger portion 112B. The passage 106 extends between the longer portion 112A and 112B and shorter portion 114A and 114B, respectively, of each protrusion 110A, 110B. As shown in FIG. 1, outer portions of the head 304 are received between the longer portion 112A, 112B and shorter portion 114A, 114B of each protrusion 110A, 110B.

In alternative embodiments (not shown), the smaller portions 114A and 114B may be omitted from protrusions 110A and 110B, respectively. In such embodiments, the passage extends between the longer portions 112A and 112B, respectively, and the bottom surface 102. Outer portions of the head 304 may be received between the longer portion 112A, 112B of each protrusion 110A, 110B and the bottom surface 102.

When the head 304 is located in the passage 106, the longer portions 112A and 112B prevent the head 304 from moving in a vertical and a transverse horizontal direction. However, the longer portions 112A and 112B permit the head 304 to move in a longitudinal direction within the passage 106. Accordingly, the adjustment rod 302 of the leveler 300 can positioned longitudinally along the floor channel 110 while the head 304 is located in the passage 106. As will be described in more detail below, this allows the floor rail 200 to be positioned along to the floor channel 100 when the head 304 located in the passage 106. Locating the head 304 within passage 106 may improve stability of the interior wall panel when installed by inhibiting movement of the head 304 in all directions but the one required for assembly and/or disassembly.

As shown in FIG. 1, when the head 304 is located in the passage 106, the shorter portion 114A and 114B space the head 304 from the bottom surface 102 of the floor channel 100. That is, the shorter portions 114A and 114B act a seat for the head 304 that spaces the head 304 above the bottom surface 202. Since the head 304 sits on the shorter portions 114A and 114B and not directly on the bottom surface 202, a reduced surface area of the head 304 contacts the floor channel 100. This may reduce the torque needed to rotate the adjustment rod 302 since there is less friction generated between the head 304 and the floor channel 100 as the adjustment rod 304 rotates.

Referring to FIG. 2, the levelers 300A, 300B are partially located within the floor rail 200, as described above, before the floor rail 200 is installed in the floor channel 100. To locate the floor rail 200 within the floor channel 100, the floor rail 200 is slid into the floor channel 100 from one of the first and second channel ends 100A and 100B to the other of the first and second channel ends 100A and 100B, with the head 304 of the least one leveler 300 located within the passage 106. It will be understood that the opposite motion can be used to remove the floor rail 200 from the floor channel 100.

In the illustrated example, each rail wall 204A, 204B includes a longitudinally extending track 212A, 212B defined along an inner surface thereof. The tracks 212A and 212B are located below the horizontal portion 202. The support shoulder 314 of the rail support 310 includes opposed resilient distal portions 318A and 318B. The distal portions 318A and 318B snap into the tracks 212A and 212B. As best shown in FIG. 2, when the collar 312 of the rail support 310 is inserted through one of the plurality of apertures 210, from below the horizontal portion 202, the opposed resilient distal portions 318A and 318B snap into the tracks 212A and 212B, respectively. As shown to FIGS. 1 and 2, when the distal portions 318A and 318B of the support shoulder 314 are engaged within respective tracks 212A and 212B, the rail support 310 is prevented from rotating relative to the floor rail 200. This engagement may also promote contact between the support shoulder 314 and the horizontal portion 202 of the floor rail 200, thereby providing improved support for the floor rail 200.

Referring again to FIGS. 1-3, the leveling assembly 700 may also include at least one panel support 400 positionable within the floor rail 200 to support the bottom edge of the wall panel. The panel support 400 includes a support body 402, an internally threaded sleeve 408, and a bolt 416. The support body 402 has an upper surface 402U, a lower surface 402L, and a substantially vertical bore 404 extending therethrough. The lower surface 402L rests on the horizontal portion 202 of the floor rail 200. The support body 402 is sized so that it cannot rotate when the lower surface 402L is resting on the horizontal portion 202 of the floor rail 200.

The sleeve 408 is rotatably secured in the bore 404 of the support body 402. In the illustrated example, the sleeve 410 snaps into the bottom edge of the bore 402 via a pair of prongs 406 (best shown in FIG. 3, where only one of the pair is visible). The sleeve 410 is capable of rotating within the bore 404 independently of the support body 402. As shown in FIG. 3, the sleeve 408 has a flange 410 at an upper end thereof. The flange 410 can be used to rotate the sleeve 410.

In the illustrated example, the flange 410 is hex-shaped so that it can be turned like a nut. However, those skilled in the art will appreciate that any other suitable flange shapes may be used. With reference to FIGS. 1 and 2, when the sleeve 408 is secured in the bore 404, the flange 410 is located above the upper surface 402U of the support body 402.

The bolt 416 has a hat 418 and a threaded rod 420 projecting from the hat 418. The rod 420 is threadedly received within the sleeve 408. The hat 418 supports the bottom edge 900B of the interior wall panel 900 (shown in FIGS. 5A-5C). With reference to FIGS. 1 and 2, the hat 418 defines a groove 422 in which the bottom edge 900B of the interior wall panel 900 is received.

The panel support 400 is capable of providing a fine leveling adjustment for the interior wall panel. Prior to the interior wall panel being supported by the panel support 400, the flange 410 can be rotated (e.g. with a wrench or by hand), to provide fine leveling, if necessary. Rotating the flange 410 causes vertical movement of the bolt 416 along the sleeve 408, thereby varying a vertical distance between the hat 418 and the horizontal portion 202 of the floor rail 200. As described above, the bottom edge of the interior wall panel sits within the groove 422 of the hat 418. Thus, varying the vertical distance between the hat 418 and the horizontal portion 202 of the floor rail 200 also varies a vertical distance between the bottom edge of the interior wall panel and the horizontal portion 202 of the floor rail 200. Once the interior wall panel is supported by the panel support 400, the flange 410 can be rotated (e.g. with a wrench), to provide further fine leveling, if necessary.

In the illustrated example, the support body 402 is not mechanically secured to the floor rail 200. As a result, before the interior wall panel is supported by panel support 400, the support body 402 can be moved along the floor rail 200 as desired. Once the interior wall panel is supported by the panel support 400, the weight of the interior wall panel on the panel support 400 maintains the position of the panel support 400 within the floor rail 200. In one or more alternative embodiments, the support body 402 may be mechanically secured to floor rail 200, such as by fasteners or adhesive.

As shown in FIG. 3, the leveling assembly 700 includes two panel supports 400A and 400B positioned within floor rail 200. In this example, the flange 410 of one or both the panel supports 400A and 400B may be rotated to provide the fine leveling adjustment for the interior wall panel. Panel supports 400A and 400B may be positioned within floor rail 200 so that they are spaced about 2 to 6 inches (5.1 to 15.2 cm) inwardly from opposite side edges of the wall panel. Preferably, panel supports 400A and 400B are positioned within floor rail 200 so that they are spaced about 4 inches (10.2 cm) inwardly from opposite side edges of the wall panel. Alternatively, the panel supports 400A and 400B may be spaced at any suitable interval. The number of panel supports 400 positioned within the floor rail 200, and/or the spacing between panel supports 400, may be varied according to the size and/or weight of the interior wall panel to be supported by the floor rail 200.

Referring again to FIGS. 1-3, the leveling assembly 700 may also include a pair of elongate floor trim members 500A and 500B. Each floor trim member 500A, 500B is releasably secured to an upper portion 208A, 208B of a corresponding one of the pair of rail walls 204A and 204B. The floor trim member 500A and 500B hide internal components of the leveling assembly 700, thereby providing for an improved aesthetic appearance. In the illustrated example, the floor trim members 500A and 500B are an aluminum extrusion or another suitable metal or alloy extrusion.

Each floor trim member 500A, 500B includes a longitudinally extending ridge 502A, 502B along an inner surface 504A, 504B thereof. The ridge 502A and inner surface 504A define an insertion slot 510A therebetween. Similarly, the ridge 502B and the inner surface 504B define an insertion slot 510B therebetween. As best shown in FIG. 1, the insertion slot 510A of the floor trim member 500A receives the upper portion 208A of the rail wall 204A, while the insertion slot 510B of floor trim member 500B receives the upper portion 208B of the rail wall 204B. In the illustrated example, the floor trim members 500A and 500B are structurally identical to each another and can be secured to either the upper portion 208A of rail wall 204A or the upper portion 208B of rail wall 204B. From a manufacturing, cost, and/or ease of installation standpoint, this may be convenient.

Referring to FIG. 1, the configuration of the upper portions 208A and 208B of corresponding rail walls 204A and 204B generally compliment the configuration of the ridges 502A and 502B of corresponding floor trim members 500A and 500B. In this way, when the upper portions 208A and 208B are received in corresponding insertion slots 510A and 510B, the ridges 502A and 502B may interlock with corresponding upper portions 208A and 208B. This can provide improved the engagement between the floor trim member 500A and 500B and corresponding rail walls 204A and 204B. In one or more alternative embodiments, each floor trim member 500A and 500B may be secured to one of the corresponding pair of rail walls 204A and 204B in other suitable ways, e.g. by mechanical fasteners, adhesive, etc.

With reference to FIGS. 1 and 2, each floor trim member 500A, 500B has a longitudinally extending trim lip 512A, 512B along a bottom edge thereof. As shown in FIG. 1, when the floor trim members 500A and 500B are secured to the rail walls 104A and 104B, respectively, the trim lips 512A and 512A abut corresponding rail walls 204A and 204B. In this arrangement, the trim lips 512A and 512B prevent the rest of the floor trim member 500A and 500B from overlaying the rail wall 204A and 204B, respectively. This can limit the amount of surface-to-surface contact between i) the floor trim member 500A and the rail wall 204A and ii) the floor trim member 500B and the rail wall 204B. This may simplify installation, reduce wear caused by shear, and/or improve stability of the leveling assembly 700.

Figure 4:
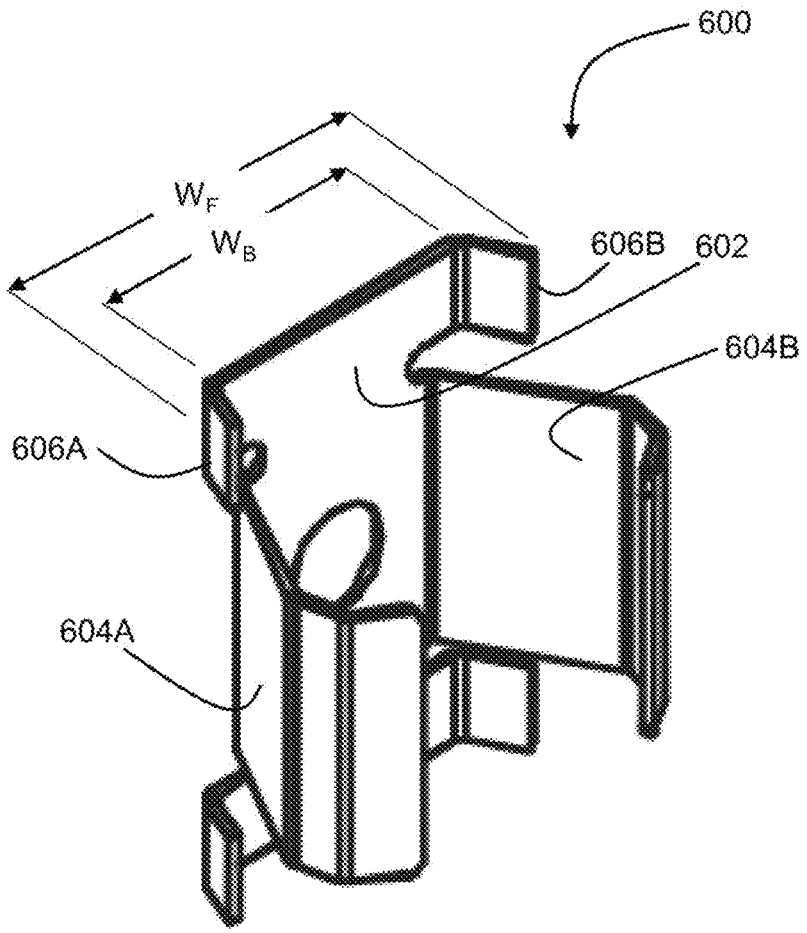
FIG. 4 is a perspective view of an example spring clip that may be used in the leveling assembly of FIG. 1.

Referring now to FIGS. 1, 3 and 4, the leveling assembly 700 may also include at least one spring clip 600 positioned in the floor rail 200. As shown in FIG. 1, the spring clip 600 snap fits: i) the upper portion 208A of the rail wall 204A into the insertion slot 510A of the floor trim member 500A, and ii) the upper portion 208B of the rail wall 204B into the insertion slot 510B of the floor trim member 500B. As shown in FIG. 3, the leveling assembly 700 includes three spring clips 600A, 600B and 600C spaced at regular intervals within the floor rail 200.

The spring clips 600 may be spaced at any suitable interval. For example, the spring clips 600 may be spaced at an interval between about 5 and 20 inches (12.7 and 50.8 cm). Preferably, the spring clips 600 may be spaced at an interval between about 10 and 14 inches (25.4 and 35.6 cm). More preferably, the spring clips 600 are spaced at an interval of about 12 inches (30.5 cm). The spring clips 600A, 600C that are closest to the rail ends 200A, 200B, respectively, are preferably positioned within floor rail 200 so that they are spaced about 1 inch (2.5 cm) from the corresponding rail ends. The number of spring clips 600 positioned within the floor rail 200, and/or the spacing between spring clips 600, may be varied according to the size and/weight of the interior wall panel, as well as other site-specific considerations. It will be understood that increasing the number of spring clips 600 will provide greater stability between the floor trim members 500A and 500B and the rail walls 204A and 204B, respectively.

FIG. 4 illustrates an exemplary spring clip 600 that is positionable within the floor rail 200 to snap the floor trim members 500A and 500B to corresponding rail walls 204A and 204B. The spring clip 600 includes a base 602 and a pair of opposed flexible spring arms 604A and 604B that extend outwardly from the base 602. The arms 604A and 604B are outwardly biased and deformable about the base 602.

The spring clip 600 also includes a pair of resilient, outwardly biased, opposed fingers 606A and 606B extending from opposing edges of the base 602. As shown, a width $W_B$ of the base 602 measured between the opposing edges is smaller than a width $W_F$ measured between tips of the opposed fingers 606A and 606B. As will described in more detail below, the opposed fingers 606A and 606B can help position and hold the spring clip 600 within the floor rail 200.

Returning to FIG. 1, the base 602 of the spring clip 600 is positioned within the floor rail 200.

In the illustrated example, each rail wall 204A, 204B includes a longitudinally extending niche 216A, 216B along the inner surface thereof. As best shown in FIG. 2, the niches 216A and 216B are located above the horizontal portion 202 and oppose each other.

In the illustrated example, the spring clip 600 snap fits into the floor rail 200. As the base 604 of the spring clip 602 is pressed downwardly into the floor rail 200, the niches 216A and 216B snap the opposed fingers 606A and 606B, respectively. The outwardly biased opposed fingers 606A and 606B press against corresponding rail walls 204A and 204B to inhibit movement of the spring clip 600 along the floor rail 200. At the same time, the distal ends of the fingers 606A, 606B abut against the niches 216A, 216B to prevent the clip 600 from popping out of the floor rail 200.

With continued reference to FIG. 1, when the spring clip 600 is positioned in the floor rail 200, the outwardly biased spring arms 604A and 604B press against the corresponding rail walls 204A and 204B. In this arrangement, the upper portion 208A of the rail wall 204A is inserted in the insertion slot 510A of the floor trim member 500A. Applying downward force to the floor trim member 500A presses the ridge 502A between the arm 604A and the upper portion 208A. In doing so, the arm 604A deforms slightly inwardly to permit the upper portion 208A to be received in the insertion slot 510A. Deformation of the arm 604A increases until the upper portion 208A of the floor rail 204A is snapped into the insertion slot 510A. Floor trim member 500B is snapped to the upper portion 208B of the rail wall 204B in the same manner.

When the trim members are 500A, 500B are connected to the corresponding rail walls 208A, 208B, the arms 604A and 604B provide a holding force to retain the upper portions 208A and 208B within the insertion slots 510A and 510B.

The floor trim members 500A, 500B can be removed from the panel assembly 700 by sliding each floor trim member along the upper portion 208A, 208B of the corresponding rail wall 204A, 204B until the upper portion exits the corresponding insertion slot 510A, 510B.

Referring again to FIGS. 1-3, each floor trim member 500A, 500B includes a longitudinally extending gasket 508A, 508B along the inner surface 504A and 504B thereof. When the floor trim members 500A and 500B are respectively secured to upper portions 208A and 208B of corresponding rail walls 204A and 204B, the gasket 508A and 508B of each trim member 500A and 500B abuts opposing surfaces of the interior wall panel 900 (shown in FIGS. 5A-5C). The floor trim members 500A and 500B may improve the stability of the interior wall panel by abutting the opposing surfaces of the interior wall panel along opposite sides. The gaskets 508A and 508B provide improved sound attenuation and insulation. The gaskets 508A and 508B are preferably made from a soft and resilient material that can protect the interior wall panel, such as for example polyurethane foam core and polyethylene film.

The floor channel 100, the floor rail 200 and each floor trim member 500A and 500B may be cut to a desired length, either on-site or off. In one example, the floor channel 100, the floor rail 200 and the floor trim members 500A and 500B are cut such that their lengths are generally equal, e.g. as shown in FIG. 3.

Reference is now made to FIGS. 5A-5C to describe the operation of the leveling assembly 700 in an example interior wall system, referred to generally as 1000. The interior wall system 1000 includes the leveling assembly 700 of FIGS. 1-3, an elongate ceiling channel 800 and an interior wall panel 900 that is held in place between the leveling assembly 700 and the ceiling channel 800.

The interior wall system 1000 is positioned in its desired location. The floor channel 100 of the leveling assembly is secured to the floor 1002. Preferably, the floor channel 100 is secured to the floor 1002 by fasteners (not shown). The floor channel 100 follows the slope of the floor 1002. As shown, the leveling assembly 700 supports a bottom edge 900B of the interior wall panel 900 above the floor 1002.

In the illustrated example, the interior wall panel 900 is made from glass. However, it will be understood that it is not essential that the interior wall panels be made of glass. The interior wall panels may be made from any other suitable material, whether transparent, translucent, or opaque.

The ceiling channel 800 is secured to a ceiling 1004 above the leveling assembly 700. The ceiling channel 800 has a top surface 802 that abuts the ceiling 1004. In the illustrated example, the ceiling channel 800 includes a pair of spaced apart channel walls 804A and 804B extending downwardly and perpendicularly from opposing edges of the top surface 802, thereby giving the ceiling channel 800 a generally inverted U-shaped cross-section. The top surface 802 and channel walls 804A and 804B define an interior space 806.

The ceiling channel 800 can be secured to the ceiling 1004 in a number of suitable ways. Preferably, the ceiling channel 800 is secured to the ceiling 1004 by fasteners (not shown). The ceiling channel 800 follows the slope of the ceiling 1004. A top edge 900T of the interior wall panel 900 is located within the interior space 806 of the ceiling channel 800. The interior space 806 can accommodate vertical movement of the top edge 900T of interior wall panel 900 therein.

As described above, the vertical distance between the horizontal portion 202 of the floor rail 200 and the bottom surface of the floor channel 100 can be adjusted by rotating the adjustment rod 302 of the levelers 300. The adjustment rod 304 of each leveler 300 may be rotated until the floor rail 200 is substantially level with the horizontal. Any suitable means, such as a conventional bubble or laser level, may be used to guide the leveling of the floor rail 200. After leveling, the floor rail 200 is substantially level with the horizontal while the floor channel 100 still follows the slope of the floor 1002.

As described above, the vertical distance between the hat 418 of the panel support 400 and the horizontal portion 202 of the floor rail 200 can be adjusted by rotating the flange 410 of sleeve 408. In this way, the panel supports 400 can be used to provide fine leveling, if necessary. This fine leveling can facilitate close alignment of the vertical edges of adjacent interior wall panels 900 in order that the adjacent walls panels 900 can be joined to each other, such as with adhesive tape.

After the leveling assembly 700 and the ceiling channel 800 are respectively secured to the floor 1002, and the ceiling 1004 and the floor rail 200 are substantially level with the horizontal, the interior wall panel 900 is positioned into the interior space 806 of the ceiling channel 800 and then lowered onto the hat 418 of the panel supports 400. The bottom edge 900B of the interior wall panel 900 is received in the groove 422 of each hat 418. If necessary, additional fine leveling adjustment may be provided by rotating the flange 410 of the at least one panel support 400 (e.g. with a wrench).

Lastly, the trim members 500A and 500B can be secured to the upper portions 208A and 208B of corresponding rail walls 204A and 204B as described above. The floor trim members 500A and 500B hide the internal components of the leveling assembly 700 to provide a more pleasing appearance and provide improved structural support.

The interior wall panel 900 of the interior wall system 1000 of FIGS. 5A-5C has a wall panel height $H_{WP}$ measured between the top edge 900T and the bottom edge 1000B thereof. In some cases, the preferred wall panel height $H_{WP}$ can be determined through measurement on site based on floor to ceiling dimensions.

FIGS. 5A-5C show the leveling assembly 700 of the interior wall system 1000 at three different heights. FIG. 5A shows the leveling assembly 700 in an uppermost of the three heights. FIG. 5C shows the leveling assembly 700 in a lowermost of the three heights. FIG. 5B shows the leveling assembly 700 at an intermediate height. It can be observed that the wall panel height $H_{WP}$ is unchanged across the different configurations illustrated in FIGS. 5A-5C, while the floor to ceiling dimensions have changed.

The example leveling assembly 700 described herein accommodates for variations in floor to ceiling dimensions. Additionally, the example wall system 1000 described herein facilitates easy assembly and disassembly, which has several advantages. One advantage is the ability by the owner to disassemble the system and reassemble it in a different building. A second advantage is the system is beneficial for the environment because it can be reused and does not necessarily require disposal if the owner of the system moves to a new building.

For longer runs, several interior wall systems 1000 may be connected in series. Elbow brackets (not shown) may be mounted to the leveling assembly 700 and/or the ceiling channel 800 at the joint of adjacent wall panels 900 to secure and align the wall panels 900.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A leveling assembly for leveling a bottom edge of an interior wall panel, the interior wall panel configured for installation on a floor, the leveling assembly comprising:

an elongate floor channel configured to be operatively secured to the floor, the floor channel having a bottom surface;

a floor rail configured to be at least partially disposed within the floor channel, the floor rail having a generally horizontal portion and a pair of spaced apart rail walls extending upwardly from the horizontal portion, wherein a plurality of apertures are defined along the horizontal portion, the floor rail configured to operatively support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is substantially prevented from transverse movement; and a rail support having a collar and a support shoulder extending outwardly from the collar, the collar having an interior threaded surface configured to engage the threaded portion of the adjustment rod, wherein the collar is configured to pass through one of the plurality of apertures in the horizontal portion, wherein the support shoulder is configured to abut against a lower surface of the horizontal portion to support the floor rail, wherein rotation of the adjustment rod is configured to vary a vertical distance between the horizontal portion of the floor rail and the bottom surface of the floor channel, wherein a pair of spaced apart, elongate, substantially parallel protrusions extend upwardly from the bottom surface of the floor channel, wherein each protrusion comprises a longer portion and a shorter portion, wherein outer portions of the head are received between the shorter portion and the longer portion of each protrusion.

2. The leveling assembly of claim 1, wherein the floor channel comprises a longitudinal passage, wherein, when the head is coupled in the floor channel: (i) the head is located in the passage, (ii) the head is free to rotate, and (iii) the head is substantially prevented from transverse horizontal and vertical movement.

3. The leveling assembly of claim 1, wherein the pair of spaced apart rail walls extend upwardly and downwardly from the horizontal portion.

4. The leveling assembly of claim 1, further comprising at least one panel support configured to be positioned within the floor rail, wherein the at least one panel support is configured to support the bottom edge of the interior wall panel.

5. The leveling assembly of claim 4, wherein the at least one panel support comprises:

a support body having an upper surface, a lower surface, and a substantially vertical bore extending therethrough, wherein the lower surface is configured to rest on the horizontal portion of the floor rail;

an internally threaded sleeve configured to be rotatably secured in the bore of the support body, the sleeve having a flange at an upper end thereof, wherein, when the sleeve is secured in the bore, the flange is located above the upper surface; and a bolt having a hat and a threaded rod projecting from the hat, wherein the threaded rod is adapted to be threadedly received within the sleeve, wherein the hat defines a groove adapted to receive the bottom edge of the interior wall panel, wherein rotation of the flange causes vertical movement of the bolt, thereby varying a vertical distance between the hat and the horizontal portion of the floor rail.

6. The leveling assembly of claim 1, further comprising a pair of elongate floor trim members, wherein each floor trim member is releasably securable to an upper portion of a corresponding one of the pair of rail walls.

7. The leveling assembly of claim 6, wherein each floor trim member comprises a longitudinally extending ridge along an inner surface thereof, the ridge and the inner surface defining an insertion slot therebetween, wherein the insertion slot is configured to receive the upper portion of a corresponding one of the pair of rail walls.

8. The leveling assembly of claim 7, further comprising at least one spring clip configured to be positioned within the floor rail, wherein the at least one spring clip is configured to snap fit the upper portion of each rail wall to the insertion slot of a corresponding one of the pair of floor trim members.

9. The leveling assembly of claim 8, wherein each floor trim member comprises a longitudinally extending gasket along the inner surface thereof, wherein, when each floor trim member is secured to the upper portion of a corresponding one of the pair of rail walls, the gasket of each trim member abuts opposing surfaces of the interior wall panel.

10. The leveling assembly of claim 1, wherein the floor channel comprises a pair of spaced apart channel walls extending upwardly and perpendicularly from opposing edges of the bottom surface.

11. The leveling assembly of claim 10, wherein the floor channel comprises a pair of elongate footings configured to rest on the floor, wherein each footing projects outwardly from a corresponding one of the pair of channel walls.

12. The leveling assembly of claim 3, wherein each rail wall comprises a longitudinally extending track defined along an inner surface thereof below the horizontal portion, wherein opposing resilient distal portions of the support shoulder are configured to snap into the track.

13. A leveling assembly for leveling a bottom edge of an interior wall panel, the interior wall panel configured for installation on a floor, the leveling assembly comprising:

an elongate floor channel configured to be operatively secured to the floor, the floor channel having a bottom surface;

a floor rail configured to be at least partially disposed within the floor channel, the floor rail having a generally horizontal portion and a pair of spaced apart rail walls extending upwardly from the horizontal portion, wherein a plurality of apertures are defined along the horizontal portion, the floor rail configured to operatively support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is substantially prevented from vertical movement relative to the floor channel; and a rail support having a collar and a support shoulder extending outwardly from the collar, the collar having an interior threaded surface configured to engage the threaded portion of the adjustment rod, wherein the collar is configured to pass through one of the plurality of apertures in the horizontal portion, wherein the support shoulder is configured to abut against a lower surface of the horizontal portion to support the floor rail, wherein rotation of the adjustment rod is configured to vary a vertical distance between the horizontal portion of the floor rail and the bottom surface of the floor channel, wherein a pair of spaced apart, elongate, substantially parallel protrusions extend upwardly from the bottom surface of the floor channel, wherein each protrusion comprises a longer portion and a shorter portion, wherein outer portions of the head are received between the shorter portion and the longer portion of each protrusion.

14. The leveling assembly of claim 13, wherein the pair of spaced apart rail walls extend upwardly and downwardly from the horizontal portion.

15. The leveling assembly of claim 13, further comprising at least one panel support configured to be positioned within the floor rail, wherein the at least one panel support is configured to support the bottom edge of the interior wall panel.

16. The leveling assembly of claim 13, further comprising a pair of elongate floor trim members, wherein each floor trim member is releasably securable to an upper portion of a corresponding one of the pair of rail walls.

17. A leveling assembly for leveling a bottom edge of an interior wall panel, the interior wall panel configured for installation on a floor, the leveling assembly comprising:

an elongate floor channel configured to be operatively secured to the floor, the floor channel having a bottom surface;

a floor rail configured to be at least partially disposed within the floor channel, the floor rail having a generally horizontal portion and a pair of spaced apart rail walls extending upwardly from the horizontal portion, wherein a plurality of apertures are defined along the horizontal portion, the floor rail configured to operatively support the bottom edge of the interior wall panel; and at least one leveler configured to be at least partially located in the floor channel, the leveler comprising:

a head;

an adjustment rod projecting from the head, the adjustment rod having a threaded portion, wherein the head is configured for removable coupling to the floor channel, wherein, when the head is coupled to the floor channel, the head is substantially prevented from transverse movement relative to the bottom surface of the floor channel; and a rail support having a collar and a support shoulder extending outwardly from the collar, the collar having an interior threaded surface configured to engage the threaded portion of the adjustment rod, wherein the collar is configured to pass through one of the plurality of apertures in the horizontal portion, wherein the support shoulder is configured to abut against a lower surface of the horizontal portion to support the floor rail, wherein rotation of the adjustment rod is configured to vary a vertical distance between the horizontal portion of the floor rail and the bottom surface of the floor channel, wherein a pair of spaced apart, elongate, substantially parallel protrusions extend upwardly from the bottom surface of the floor channel, wherein each protrusion comprises a longer portion and a shorter portion, wherein outer portions of the head are received between the shorter portion and the longer portion of each protrusion.

18. The leveling assembly of claim 17, wherein the pair of spaced apart rail walls extend upwardly and downwardly from the horizontal portion.

19. The leveling assembly of claim 17, further comprising at least one panel support configured to be positioned within the floor rail, wherein the at least one panel support is configured to support the bottom edge of the interior wall panel.

* * * * *